United States Patent [19]

Joyce

[11] Patent Number: 4,464,160

[45] Date of Patent: Aug. 7, 1984

[54] METHOD AND APPARATUS FOR FORMING A HEM IN FABRIC FLAT GOODS

[75] Inventor: William R. Joyce, Gerton, N.C.

[73] Assignee: Tex-Fab, Inc., Gerton, N.C.

[21] Appl. No.: 301,539

[22] Filed: Sep. 14, 1981

[51] Int. Cl.[3] ..... B65H 44/22; D05B 35/02

[52] U.S. Cl. ..... 493/448; 112/141; 112/147; 112/262.3; 112/DIG. 3; 493/451

[58] Field of Search ..... 493/448, 451, 446, 447; 112/262.3, 147, 141, 121.12, 121.15, DIG. 1, DIG. 2, DIG. 3, 304

[56] References Cited

U.S. PATENT DOCUMENTS

| | | | |
|---|---|---|---|
| 2,583,746 | 1/1952 | Peterson | 493/446 X |
| 3,171,646 | 3/1965 | Melton, Jr. | 270/66 |
| 3,277,851 | 5/1964 | Dobner et al. | 112/2 |
| 3,463,482 | 9/1966 | Baron et al. | 270/93 |
| 3,534,954 | 10/1970 | Lynch, Jr. | 270/93 |
| 3,588,089 | 6/1971 | Flanagan | 270/93 |
| 3,628,476 | 12/1971 | Flanagan | 112/147 |
| 3,772,948 | 11/1973 | Burton | 83/23 |
| 3,867,889 | 2/1975 | Conner, Jr. | 112/121.11 |
| 3,898,941 | 8/1975 | Crawford | 112/121.29 |
| 3,965,647 | 6/1976 | Sjoman | 493/446 X |
| 4,003,323 | 1/1977 | Crawford | 112/141 |
| 4,066,025 | 1/1978 | Speer | 112/121.29 |
| 4,068,603 | 1/1978 | Arbter | 112/121.11 |
| 4,095,537 | 6/1978 | Silverman et al. | 112/121.29 |
| 4,095,538 | 6/1978 | Rockerath et al. | 112/147 |
| 4,188,024 | 2/1980 | Seragnoli | 493/448 X |
| 4,321,051 | 3/1982 | Hajek et al. | 493/446 X |

*Primary Examiner*—H. Hampton Hunter

*Attorney, Agent, or Firm*—Luedeka & Neely

[57] ABSTRACT

A method and apparatus for forming a hem in fabric flat goods is disclosed. The method includes the steps of folding the border of the fabric flat goods back over to form a major hem, holding the major hem in place by vacuum, folding the free edge of the major hem back into the fold of the major hem to form a minor hem, clamping the major and minor hems in a movable clamp and moving the clamped together hems to a sewing machine. The apparatus includes a table having a longitudinally extending vacuum slot parallel to one of its sides, a major hem forming plate movable to a position over the table top for forming the major hem, a minor hem forming plate also movable to a position over the table top for forming the minor hem, and a movable clamping device for clamping the hems together and delivering the hems to a sewing machine which stitches the hems.

7 Claims, 7 Drawing Figures

METHOD AND APPARATUS FOR FORMING A HEM IN FABRIC FLAT GOODS

The present invention relates to forming hems in material, and more particularly to a method and apparatus for forming a double hem in fabric flat goods, and the like, on a high volume basis with a minimum of human involvement.

Historically, it has been the practice to form hems in fabric flat goods, such as for example, bed sheets, tablecloths, curtains, draperies, and the like, by hand. Usually, a hem is progressively formed in the fabric material by hand as it is being manually fed through a sewing machine. This method has been employed for forming hems in individual items such as bed sheets, tablecloths, curtains, and the like, but it is uneconomical because of the labor involved. Also, a great deal of skill is required to provide a hem which is true.

Past attempts at automating the forming of hems in fabric flat goods have included variations of a stationary hem fold forming device usually having an open ended slot of some type through which the fabric material passes on its way to a sewing station. As the fabric material longitudinally passes through the slot in the hem forming device, the longitudinal border of the fabric material is caused to fold over itself to form a hem. However, an operator is required to make sure that the fabric material is properly fed through the hem forming device and even so, the hems are not as straight and pucker free as desired.

It is an object of the present invention to form a double hem in fabric flat goods on a high volume basis with a minimum of human supervision.

It is another object of the present invention to form a hem along the entire edge of fabric at one time.

A further object of the present invention is to form a double hem along the entire edge of the fabric before the sewing operation has begun.

Figure 1:
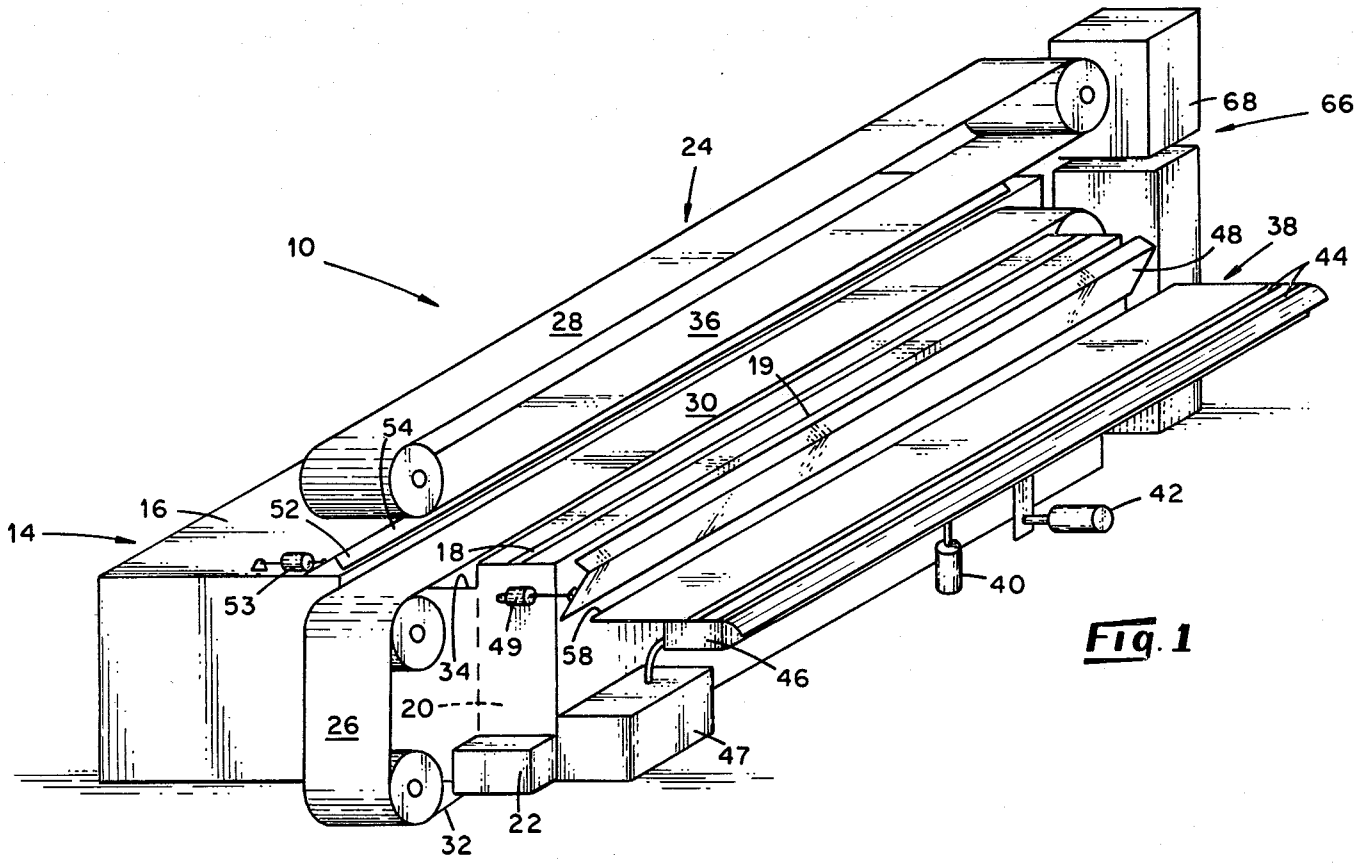

Other objects and advantages of the invention will become known by reference to the following description and drawings in which:

FIG. 1 is a diagrammatic, perspective view of a hem forming apparatus embodying various features of the present invention; and, FIGS. 2 through 7 are diagrammatic, end views of a portion of the apparatus of FIG. 1, somewhat distorted to more clearly show various features, and illustrating the successive steps in the operation of the apparatus in forming a hem in fabric flat goods.

The illustrated embodiment, in general, provides an apparatus for forming a hem in fabric flat goods which comprises a table upon which the hem is formed, the top of the table being formed with a longitudinally extending vacuum slot along one of its sides; vacuum producing means operatively associated with the vacuum slot in the table top for producing a vacuum condition at the vacuum slot; major hem forming plate means movable to a position generally overlaying the vacuum slot in the table top for forming a major hem along the entire length of the fabric flat goods at one time; minor hem forming plate means movable to a position generally overlaying the vacuum slot in the table top after the major hem forming plate means has moved away from the table top for forming a minor hem along the entire length of fabric flat goods at one time; and, movable clamping means for clamping the major and minor hems together and moving the hemmed flat goods to a sewing station.

The method of forming a hem in fabric flat goods comprises the steps of folding the border of the fabric flat goods back over itself to form a major hem; applying a vacuum condition near the free edge of the major hem to hold it in place; folding the free edge of the major hem into the fold of the major hem to form a minor hem; clamping the major and minor hems in a movable clamping device; removing the vacuum condition; moving the fabric flat goods with the clamped together major and minor hems to a sewing station.

The figures diagrammatically illustrate an apparatus, generally denoted by the numeral 10, for forming a hem along the entire length of fabric flat goods 12 at one time. The illustrated apparatus 10 is useful for forming a double hem or even a single hem if desired.

As shown, the apparatus 10 includes an elongated table 14 upon which the hem will be formed. The table top 16 is formed with an elongated vacuum slot 18 longitudinally extending along the length of the table top 16 generally parallel to and near a longitudinal side 19 of the table top 16. The vacuum slot 18 may take the form of an elongated opening, as illustrated, or a series of spaced openings or the like so long as it provides means for holding the fabric in position as will hereinafter be described. A vacuum chamber 20 is located beneath the table top 16, and the vacuum slot 18 is open to the interior of the vacuum chamber 20. A vacuum pump 22 is operatively associated with the vacuum chamber 20. When the vacuum pump 22 is activated, it reduces the air pressure in the vacuum chamber 20 producing a vacuum condition at the vacuum slot 18 in the table top 16 causing an air flow through the elongated vacuum slot 18 into the chamber 20.

A movable hem clamping device, generally denoted by the numeral 24, is located at the table top 16. As shown, the movable hem clamping device 24 comprises a first endless belt conveyor 26 and a second endless belt conveyor 28. The first endless belt conveyor 26 is located with its top belt flight 30 in overlaying relationship with the table top 16 next to and parallel with the elongated vacuum slot 18, and extending along the entire length of the table top 16. The bottom belt flight 32 can extend below the vacuum chamber 20. The top belt flight 30 should be coplanar with the table top 16 in the vicinity of the vacuum slot 18. To this end, the table top 16 has a depression 34 parallel to and spaced from the vacuum slot 18. The top belt flight 30 of the first belt 26 runs longitudinally in the depression. The depression is dimensioned so that the top surface of the top belt flight 30 of the first conveyor belt 26 will be substantially in the plane of the table top 16 at the vacuum slot 18. The second belt conveyor 28 is located above the first belt conveyor 26 with the lower belt flight 36 parallel to the top belt flight 30 of the first belt conveyor 26. The second belt conveyor 28 is mounted for movement upwardly away from the top belt flight 30 of the first belt conveyor 26 and downwardly toward the first belt conveyor 26 so that the lower belt flight 36 of the second belt conveyor 28 can be selectively positioned in immediate adjacent position over the top belt flight 30 of the first conveyor 26. Both the first and second conveyor belts are driven so that the top belt flight 30 of the first conveyor 26 and the lower belt flight 36 of the second conveyor 28 move in the same direction.

An elongated major hem forming plate 38 is located along and generally parallel to the longitudinal side 19 of the table top 16. The major hem forming plate 38 is mounted for movement between a first position (see FIG. 2) below the table top 16 of the table 14 and a second position (see FIG. 3) generally inline with the table top 16 but spaced from the longitudinal edge 19 of the table top 16. The major hem forming plate 38 is also mounted for movement between the second position and a third position (see FIG. 4) overlaying the vacuum slot 18 in the table top 16 and the top flight 30 of the first conveyor 26. The major hem forming plate 38 can be moved between its first and second positions by means of, for example, a first pneumatic cylinder device 40, and can be moved between its second and third positions by means of, for example, a second pneumatic cylinder device 42.

The major hem forming plate 38 is also formed with at least one vacuum slot 44 extending longitudinally of the elongated major hem forming plate. The vacuum slot 44 may take the form of an elongated opening, as illustrated, or a series of spaced openings or the like so long as it provides means for holding the fabric in position as will be described. A vacuum chamber 46 is located beneath the major hem forming plate 38 with the vacuum slot 44 open to the interior of the vacuum chamber 46. A vacuum pump 47 is operatively associated with the vacuum chamber 46. When the vacuum pump 47 is activated, it reduces the air pressure in the vacuum chamber 46 producing a vacuum condition at the vacuum slot 44 in the major hem forming plate 38 causing an air flow through the vacuum slot 44 into the vacuum chamber 46.

An elongated minor hem forming plate 48 is located along and supported on the longitudinal side 19 of the table top 16 generally parallel to the vacuum slot 18 in the table top 16. The minor hem forming plate is hingedly mounted for movement between a first position (FIGS. 2, 3 and 4) remote from the table top 16 and a second position (FIG. 6) generally overlaying the table top at the vacuum slot 18. The minor hem forming plate 48 can be moved between the first and second positions by means of, for example, a pneumatic cylinder device 49 or solenoid. The minor hem forming plate 48 is moved in timed sequence with the major hem forming plate 38 such that the minor hem forming plate 48 is moved to its second position overlaying the table top 16 at the vacuum slot 18 after the major hem forming plate 38 has moved from its third position overlaying the table top at the vacuum slot 18 to its second position spaced from the longitudinal side 19 of the table top 16.

A fixed position major hem clamping device 52 is hingedly supported on the table top 16 near the top belt flight 30 of the first conveyor 26. The fixed position clamping device 52 includes an elongated leg 54 extending longitudinally of the table top 16 generally parallel to the top flight 30 of the first conveyor 26. The fixed position clamping device 52 is movable between a first position (FIGS. 2 through 4) with its elongated leg 54 elevated to a position spaced above the table top 16 and a second position (FIGS. 5 and 6) with its elongated leg 54 located at the table top 16 next to the top flight 30 of the first conveyor 16. The fixed position clamping device 52 can be moved between its first and second positions by virtually any conventional or otherwise convenient means such as the pneumatic cylinder device 53. The fixed position clamping device 52 is moved in timed sequence with the major hem forming plate 38 such that when the major hem forming plate 38 is in the third position overlaying the table top at vacuum slot 18 and the top belt flight 30, the fixed position clamping device 52 is in the first position with its leg 54 spaced above the table top 16, and when the major hem forming plate 38 has moved from the third position, after having formed the major hem, to the second position spaced from the longitudinal side 19 of the table top 16, the fixed position clamping device 52 moves to its second position at the table top 16 clamping the major hem in position.

The following discussion of the operational steps can be easily followed by reference to FIGS. 2 through 7 which represent the sequential steps in forming a double hem in fabric flat goods.

Figure 2:
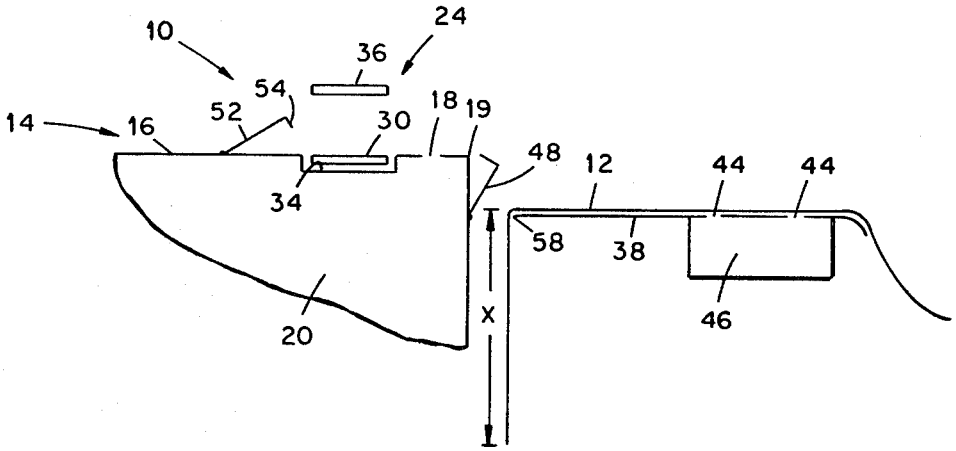
Figure 3:
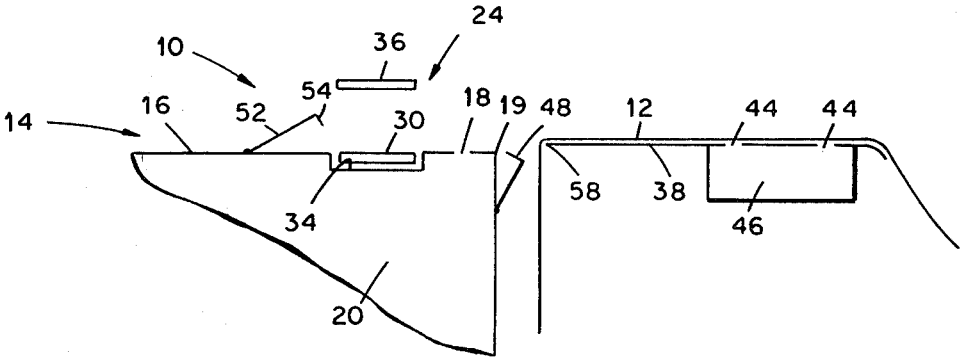
Figure 4:
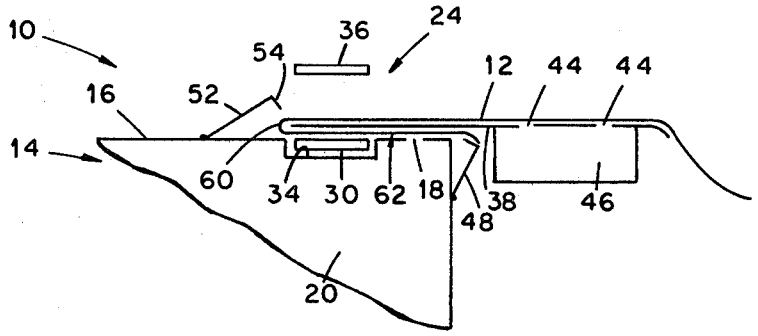

FIG. 2 illustrates the first step in forming the hem. The fabric flat goods 12 to be hemmed is laid on the major hem forming plate 38 with the longitudinal edge to be hemmed draped over the longitudinal edge 58 of the major hem forming plate 38 which is adjacent the longitudinal side 19 of the table top 16. The fabric 12 should drape over the longitudinal edge 58 of the major hem forming plate 38 by a dimension denoted as "X" which is substantially equal to the sum of the width of the major and minor hems to be formed. The rest of the fabric flat goods 12 is allowed to trail over the other longitudinal edge of the major hem forming plate 38. The vacuum pump 47 is activated to initiate an air flow through the at least one vacuum slot 44 in the major hem forming plate 38. The air flowing through the vacuum slot 44 draws the fabric flat goods downwardly against the major hem forming plate 38 to hold the fabric flat goods in position on the major hem forming plate 38 during subsequent operations to be hereinafter discussed.

The major hem forming plate 38 is moved upwardly from its first position (FIG. 2) to its second position (FIG. 3) by means of the pneumatic cylinder device 40 so that it is in-line with the table top 16.

After the major hem forming plate 38 has reached its second position (FIG. 3), the pneumatic cylinder device 42 is activated to move the major hem forming plate 38 from the second position to the third position (FIG. 4) overlaying the table top at the vacuum slot 18 and the top belt flight 30 of the first conveyor 26. As the major hem forming plate 38 moves to the third position, the draped portion "X" of the fabric flat goods 12 contacts the longitudinal side 19 of the table top 16 and is dragged under the major hem forming plate 38 between the table top 16 and underside of the major hem forming plate. Thus, the fabric flat goods 12 is folded around the longitudinal edge 58 of the major hem forming plate 38 forming a major hem fold turn 60 and the major hem 62.

Figure 5:
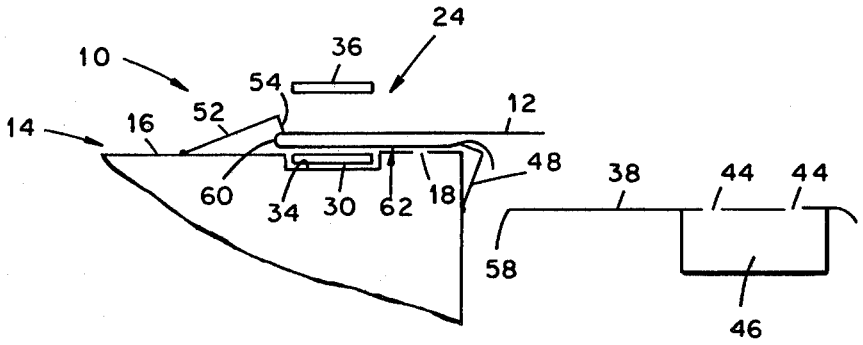

As can be best seen in FIG. 5, the vacuum pump 22 associated with the vacuum slot 18 in the table top 16 is activated to initiate an air flow through the vacuum slot 18 which draws the major hem 62 downwardly against the table top 16 to hold the major hem in position. Concurrently, the vacuum pump 47 is deactivated to remove the vacuum condition at the vacuum slots 44 in the major hem forming plate 38 and the major hem forming plate 38 is moved from its third position back to its second position.

Figure 6:
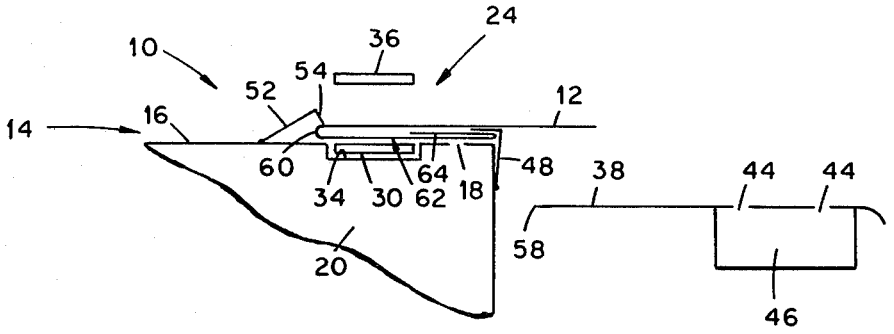

Referring to FIG. 6, after the major hem forming plate 38 has retracted from the third position back to the second position, the fixed position clamping device 52 is moved from the first position with its leg 54 spaced above the table top 16 to its second position with with leg 54 at the table top 16 clamping the major hem fold 60 between it and the table top. When the fixed position clamping device 52 has moved to the second position securing the major hem fold 60, and with the air flow through the vacuum slot 18 in the table top 16 continuing to draw the major hem 60 downwardly against the table top 16, the minor hem forming plate 48 is moved from the first position to the second position overlaying the table top at the vacuum slot 18. As the minor hem forming plate 48 moves, it contacts the free longitudinal edge of the major hem 62 and folds the free edge back into the hem fold of the major hem 62 to form a minor hem 64.

Figure 7:
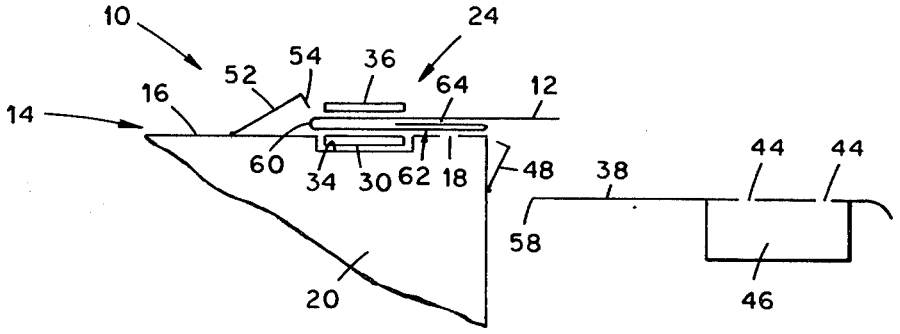

After the minor hem 64 is formed, the minor hem forming plate 48 retracts from the second position back to its first position and the second conveyor 28 is moved downwardly to the first conveyor 26 capturing the major and minor hems 60 and 64, respectively, therebetween as can be seen in FIG. 7. The vacuum pump 22 is deactivated removing the vacuum condition at the vacuum slot 18, and the fixed position clamping device 52 is moved back to its first position. The first and second conveyors 26 and 28 are activated and move the flat goods 12, with the major hem 62 and minor hem 64 captured between them, longitudinally to a sewing station 66 located at the end of the conveyors. As the hemmed portion of the fabric flat goods progressively leaves the interface of the first and second conveyors 26 and 28, it passes through a sewing machine 68 and is stitched together.

As will be apparent from the foregoing, the fabric is under control at all times through the use of clamps and vacuum so that it is possible to provide an accurate hem for piece goods such as bed sheets, drapes and the like with a minimum of labor and a minimum of required manual skill.

The foregoing detailed description is given primarily for clearness of understanding and no unnecessary limitations should be understood therefrom for modifications will be obvious to those skilled in the art upon reading this disclosure and may be made without departing from the spirit of the invention or the scope of the appended claims.

What is claimed is:

1. An apparatus for forming a hem in fabric flat goods, comprising:

a table upon which the hem is to be formed, the top of said table being formed with a longitudinally extending vacuum slot along one longitudinal side of the table top;

vacuum producing means operatively associated with said vacuum slot for selectively producing a vacuum condition at said vacuum slot while said hem is being formed;

major hem forming plate means movable to and from a position generally overlaying said vacuum slot in the table top for forming a major hem along the entire length of the fabric flat goods at one time;

minor hem forming plate means movable to and from a position generally overlaying said vacuum slot in the table top after said major hem forming plate means has moved away from the table top for forming a minor hem along the entire length of the fabric flat goods at one time; and, movable clamping means for clamping the major and minor hems and delivering the hemmed flat goods to a sewing station after said vacuum condition has been removed.

2. The apparatus of claim 1 further comprising:

said major hem forming plate being formed with at least one vacuum slot; and, vacuum producing means operatively associated with said at least one vacuum slot in said major hem forming plate for producing a vacuum condition at said vacuum slot.

3. The apparatus of claim 1, wherein said movable clamping means comprises:

a first endless belt conveyor having a top belt run in overlaying relationship with the table top near said vacuum slot in the table top and generally parallel to said vacuum slot in the table top;

a second endless belt conveyor located above said first endless belt conveyor with a lower belt run parallel to the top belt flight of said first endless belt conveyor, said second endless belt conveyor being movable toward and away from said first endless belt conveyor so that the lower belt flight of said second conveyor can be selectively positioned immediately adjacent the top flight of said first belt conveyor to capture the hem of the fabric flat goods therebetween; and, the top belt flight of said first belt conveyor and the lower belt flight of said second conveyor is driven to move in the same linear direction.

4. The apparatus of claim 1, further comprising fixed position major hem clamping means located on the table top near the top belt flight of said first belt conveyor, said fixed position major hem clamping means being movable between a first position remote from the table top and a second position at the table top for temporarily clamping the major hem in position during formation of the minor hem.

5. A method of forming a hem in fabric flat goods, comprising the steps of:

folding the border of the fabric flat goods back over to form a major hem;

applying a vacuum condition to the fabric flat goods near the free edge of the major hem to hold the major hem in place;

folding the free edge back into the fold of the major hem to form a minor hem;

clamping the major and minor hems together in a movable clamping device;

removing the vacuum condition from the fabric flat goods; and, moving the clamped together major and minor hems to a sewing station.

6. The method of claim 5, comprising the further step of clamping the hem fold of the major hem in position during the formation of the minor hem.

7. The method of claim 5, comprising the further step of applying a vacuum condition to the fabric flat goods to hold the flat goods in position during the formation of the major hem.

* * * * *